US005967641A

United States Patent [19]

Sung et al.

[11] Patent Number: 5,967,641

[45] Date of Patent: Oct. 19, 1999

[54] MULTI-PURPOSE TOOL BOX

[76] Inventors: Chin-Fu Sung; Yan-Shing Lee, both of 11F-2 43, Jan-I Street, Taichung, Taiwan

[21] Appl. No.: 09/084,475

[22] Filed: May 26, 1998

[51] Int. Cl.[6] ..... A45C 15/06

[52] U.S. Cl. ..... 362/156; 362/154; 362/191; 362/253; 362/201

[58] Field of Search ..... 362/154, 156, 362/253, 191, 190, 200, 201, 119; 206/234, 372, 373

[56] References Cited

U.S. PATENT DOCUMENTS 4,478,330 10/1984 Lin ..... 206/38
5,624,029 4/1997 Shih ..... 362/154
5,803,586 9/1998 Velez ..... 362/154
5,879,072 3/1999 Huang ..... 362/156

*Primary Examiner*—Thomas M. Sember
*Attorney, Agent, or Firm*—Charles E. Baxley, Esq.

[57] ABSTRACT

A tool box includes a cover mounted to a base which receives a receiving member, an extension rod, a collapsible member and a light means therein which is actuated by a switch member disposed to the box. The receiving member receives a plurality of bits and is pivotally disposed to the base member, a spring member is disposed between the base member and an underside of the receiving member to pop up the receiving member when the cover is opened. The extension rod can be inserted into a polygonal passage defined in an end of the box so as to connect with a bit. The collapsible member has a magnetic member disposed to a distal end thereof so as to magnetically adhere bits.

9 Claims, 4 Drawing Sheets

MULTI-PURPOSE TOOL BOX

BACKGROUND OF THE INVENTION

1. Field of the Invention

The present invention relates to a tool box comprising a receiving member for receiving bits therein, a light means, a magnetic rod and an extension rod for connecting the bit.

2. Brief Description of the Prior Art

Conventional tool boxes has only one goal which is that the tool box may receive a lots of tools therein so that a user needs not to carry different individual tools with him/her. In some situations, especially when using the tools in home, the user only uses one or two types of tools such as are a screwdriver with different shapes of bits. Therefore, a big tool box does not meet the need very well, that is to say, a smaller tool box is more useful when being used in home. Furthermore, the conventional tool box cannot provide a bright working condition itself so that when the screwdriver is used in a narrow and dark cavity, the user has to find someone to hold a light to assist him/her. In this case, the conventional tool box itself has no function at all.

The present invention provides an improved multi-purpose tool box having extension rod and different bits received therein, a light means disposed in the tool box so that the light means can be used together with the extension rod and the bit. The multi-purpose tool box well resolves the problems as mentioned above.

SUMMARY OF THE INVENTION

In one aspect of the present invention, there is provided a multi-purpose tool box which includes a cover pivotally mounted to a base which has a first side, a second side, a first end and a second end. A first separating plate and a second separating plate are respectively and longitudinally disposed to the base such that a first space is defined between the first side of the base and the first separating plate, and a second space is defined between the first and the second separating plate. The first separating plate has a slit defined therein. A tubular member is formed to the first end of the base and has a polygonal passage defined therein. A first curved recess is defined in the first end of the base and communicates with the second space.

A receiving member is pivotally connected between the first end and the second end of the base, and a spring is disposed between the base and an underside of the receiving member. The receiving member has a plurality of notches defined in a first side thereof.

A light means is received in the second space and comprises at least one battery, a bulb frame with a bulb disposed thereto. The bulb frame contacts a positive electrode of the battery. A first conducting plate is received in the first space and has a first end thereof extending through the slit of the first separating plate and contacting the bulb frame. A second conducting plate is received in the first space and has a first end and a second end which contacts a negative electrode of the battery.

A switch member is slidably disposed to the first side of the base and has a protrusion formed thereto which slidably presses the first end of the second conducting plate to separate from a second end of the first conducting plate.

It is an object of the present invention to provide a tool box which has a receiving member which is automatically pivoted upwardly when the tool box is opened.disposed multi-purpose tool box having a light means disposed therein.

It is another object of the present invention to provide a tool box having a light means disposed therein.

How these and other objects are accomplished will become apparent from the following descriptions and from the drawings.

DETAILED DESCRIPTION OF THE PREFERRED EMBODIMENT

Figure 1:
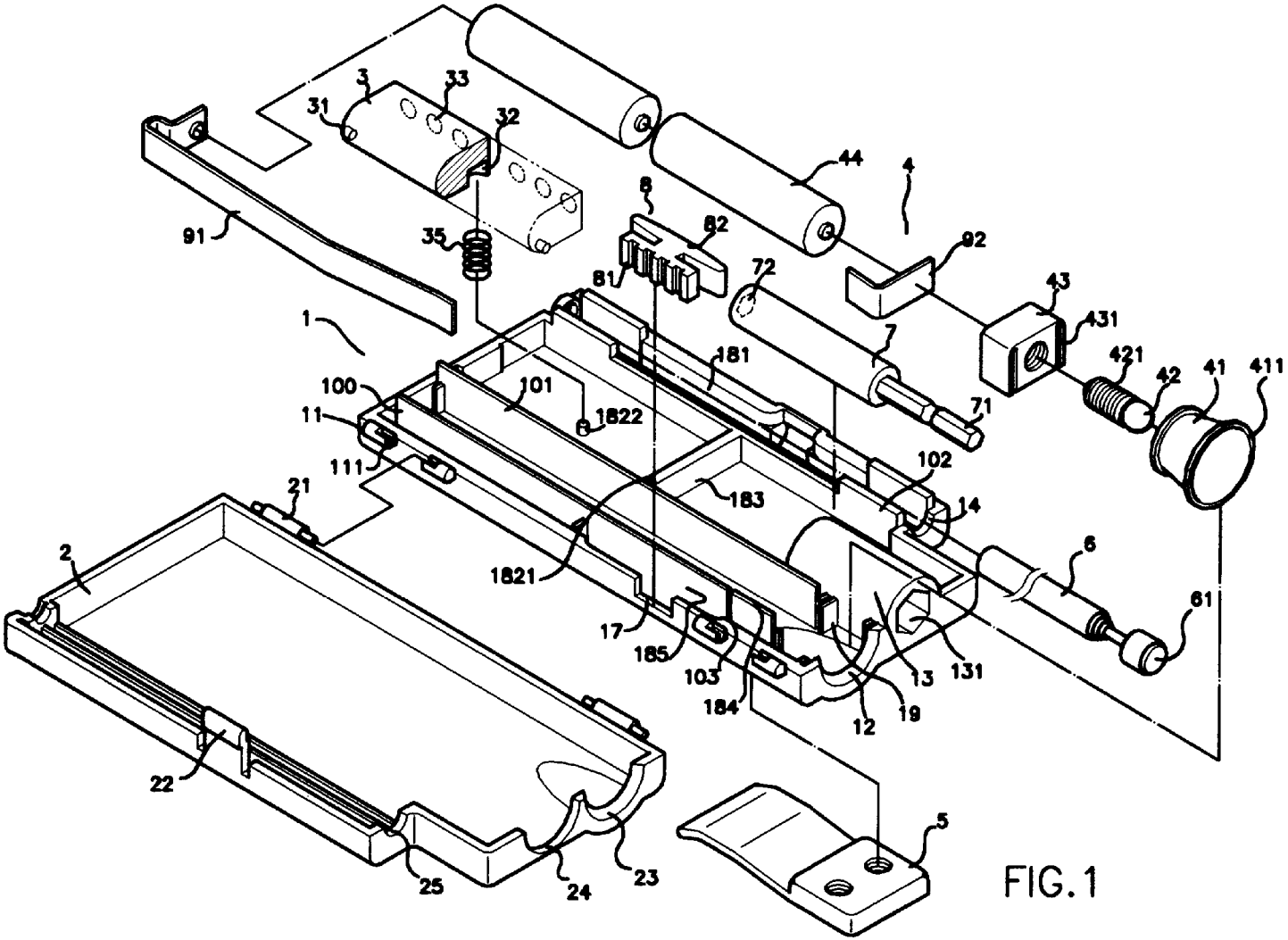
FIG. 1 is an exploded view of a tool box in accordance with the present invention.
Figure 2:
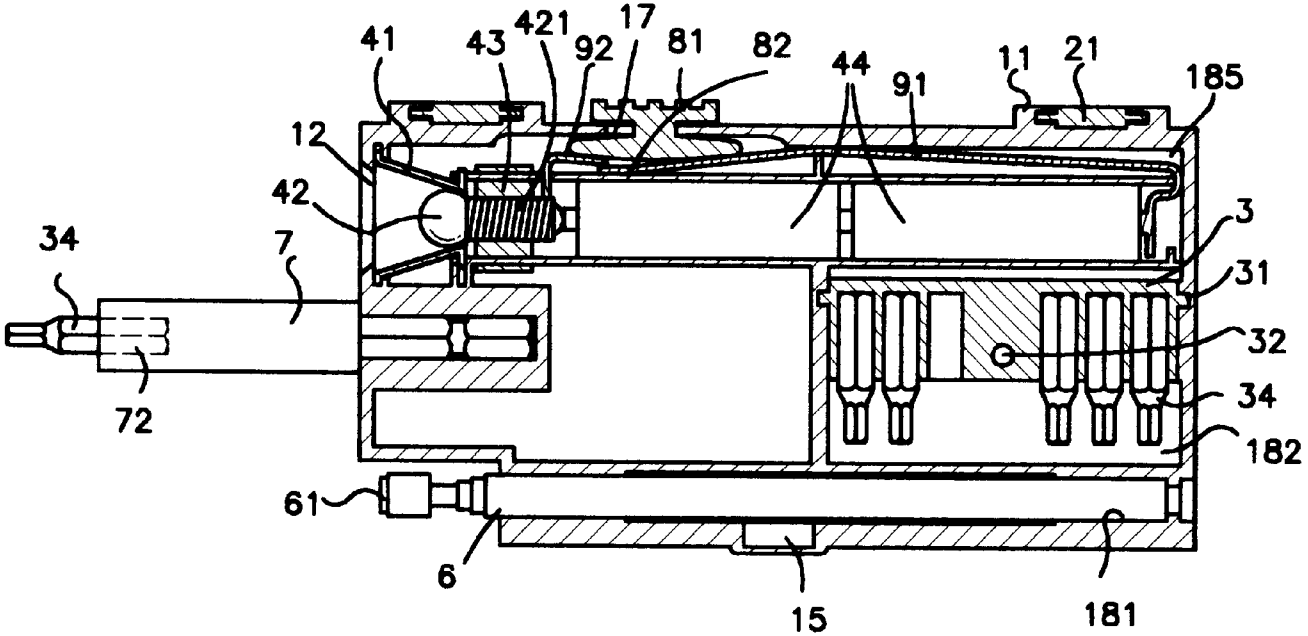
FIG. 2 is a side elevational view, partly in section, of the tool box of the present invention.

Referring to the drawings and initially to FIGS. 1 and 2, a tool box in accordance with the present invention generally includes a base 1 and a cover 2 which is pivotally mounted to the base 1 which has a first side, a second side, a first end and a second end. The first side of the base 1 has a cutaway 17 defined therein and two sets of supporting members 11 respectively disposed thereto, each of the supporting members 11 has a groove 111 defined therein so as to receive two pivots 21 on the cover 2. A first separating plate 100, a second separating plate 101 and a third separating plate 102 are respectively and longitudinally disposed to the base 1 such that a first space 185 is defined between the first side of the base 1 and the first separating plate 100, a second space 184 is defined between the first and the second separating plate 100, 101, and a third space 181 is defined between the third separating plate 102 and the second side of the base 1. A mediate plate 183 extends perpendicularly from the third separating plate 102, each of the second end and the mediate plate 183 having a dent 1821 defined therein.

A tubular member 13 is formed to the first end of the base 1 and has a polygonal passage 131 defined therein. An extension rod 7 is received between the tubular member 13 and the third separating plate 102, and has a first end being a polygonal end 71 so as to be received in the polygonal passage 131 of the tubular member 13 and a second end with a polygonal recess 72 defined therein. A first curved recess 12 and a second recess 14 are respectively defined in the first end of the base 1, wherein the first curved recess 12 communicates with the second space 184 and the second curved recess 14 communicates with the third space 181. The cover 2 has three curved recesses 23, 24, 25 defined therein which are respectively located corresponding to the tubular member 13, the first curved recess 12 and the second curved recess 14. The.cover 2 further has a lock member 22 located opposite to the two pivots 21 so as to engage with a protrusion 15 extending from the second side of the base 1. A collapsible member 6 is fixedly received in the third space 181 and has a magnetic member 61 disposed to a distal end thereof which extends from the second curved recess 14 of the first end of the base 1.

A receiving member 3 is pivotally connected between the mediate plate 183 and the second end of the base, wherein the receiving member 3 has a stub 31 extending from each one of two ends thereof so as to respectively received the stub 31 corresponding thereto. Each the stub 31 is located below a central axis of the corresponding end of the receiving member 3 and near a second side of the receiving member 3. The receiving member 3 has a recess 32 defined in an underside thereof and a boss 1822 extends from the base 1 so that a spring 35 is disposed between the boss 1822 of the base 1 and the recess 32 of the receiving member 3. The receiving member 3 has a plurality of notches 33 defined in a first side thereof so as to receive bits 34 therein.

A light means 4 is received in the second space 184 and comprises at least one battery 44, a bulb frame 421 made of conductive material with a bulb 42 disposed thereto, a positioning member 43 for the bulb frame 421 threadedly connected thereto and a reflector 41. The reflector 41 for receiving the bulb 42 therein is a cone-shaped member and has a flange 411 extending radially and outwardly from each one of two ends thereof so as to be respectively received in two pairs of grooves 19 defined in the base 1 and located adjacent the second curved recess 12. The bulb frame 421 contacts a positive electrode of the battery 44. A first conducting plate 92 is received in the first space and has a first end thereof extending through the slit 103 of the first separating plate 100 and contacting the bulb frame 421. A second conducting plate 91 is received in the first space 185 and has a first end and a second end which contacts a negative electrode of the battery 44. The first end of the second conducting plate 92 is located below a second end of the first conducting plate 92.

A switch member 8 is slidably received in the cutaway 17 of the first side of the base 1 and has knurl outer surface 181 and a protrusion 82 formed thereto which slidably presses the first end of the second conducting plate 91 so as to contact or separate from the second end of the first conducting plate 92. The base 1 further has a clamping member 5 fixedly connected to an outer side thereof so as to be clamped on a belt.

Figure 4:
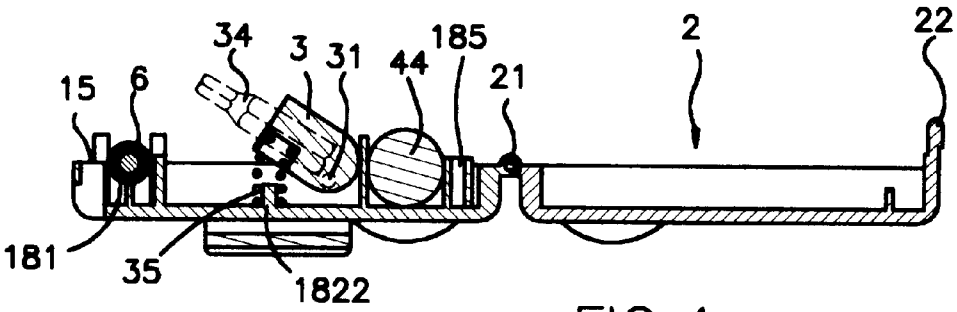
FIG. 4 is an end elevational view, partly in section, of the tool box when the cover is opened.
Figure 3:
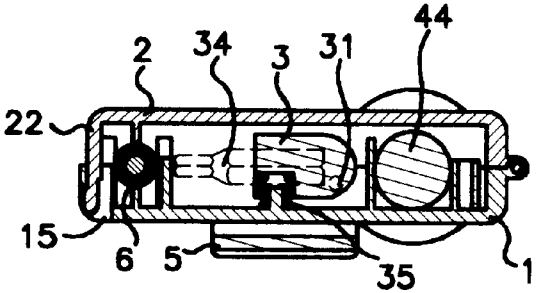
FIG. 3 is an end elevational view, partly in section, of the tool box of the present invention when a cover of the tool box is not opened yet.

When in use, referring to FIGS. 3 and 4, the cover 2 is pivoted to open the tool box and the receiving member 3 is biased upwardly and pivoted about the two stubs 31 so that a user can conveniently pick the bits 34 received in the notches 33. The extension rod 7 is picked to be inserted the polygonal end 71 thereof in the polygonal passage 131 and a bit 34 is inserted into the polygonal recess 72 of the extension rod 7 so as to use like a screwdriver.

Figure 5:
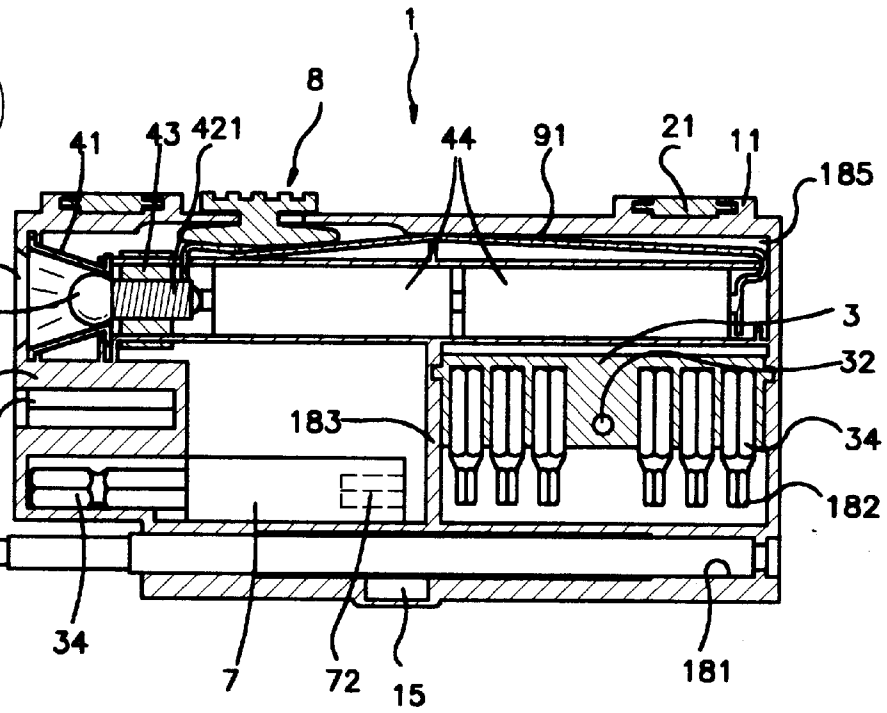
FIG. 5 is a side elevational view, partly in section, of the tool box when the light means is actuated by moving a switch member, and a collapsible member is extended to magnetically adhere a bit.
Figure 6:
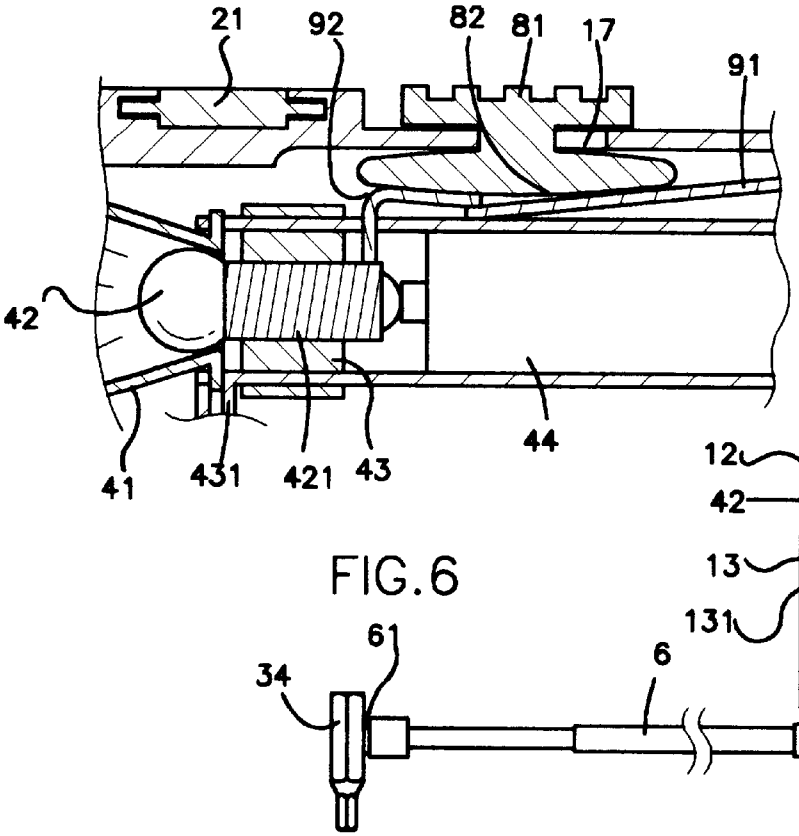
FIG. 6 is an enlarged fragmentary, partially sectional view to show the switch member makes two conducting plates to contact with each other.
Figure 8:
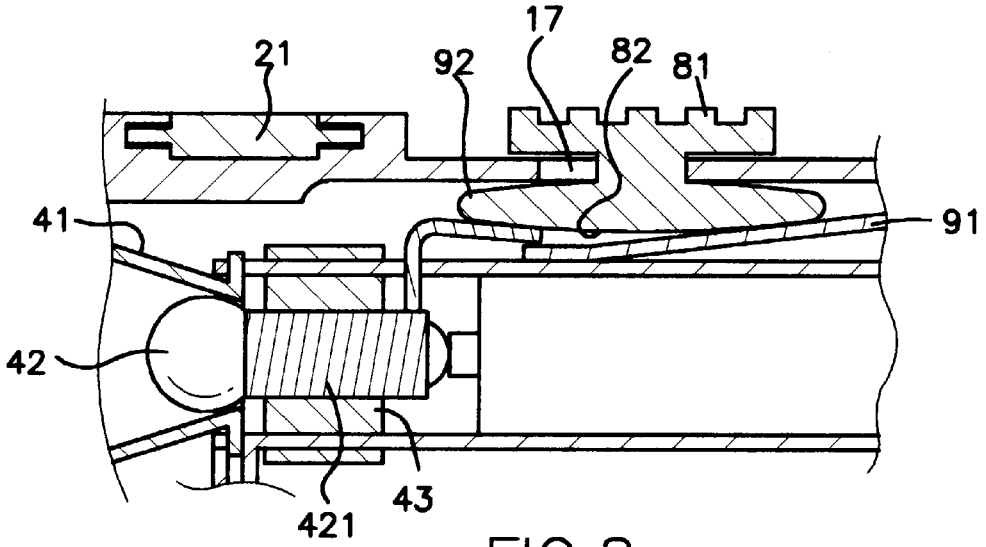
FIG. 8 is an enlarged fragmentary, partially sectional view to show the switch member makes the two conducting plates to separate from each other.
Figure 7:
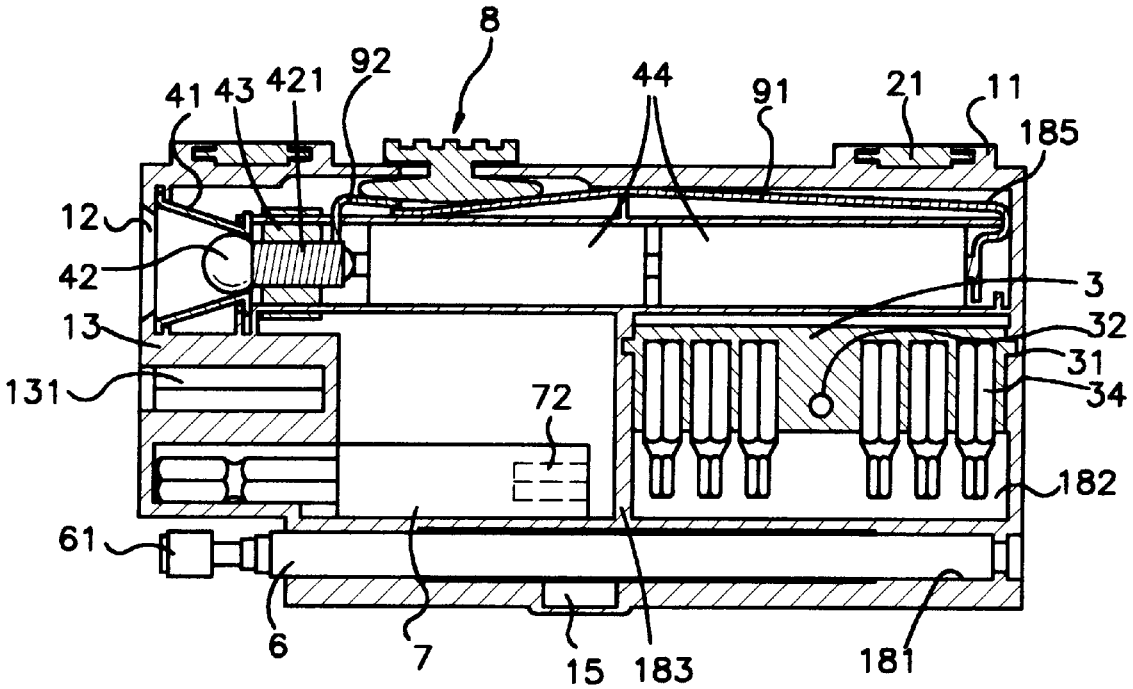
FIG. 7 is a side elevational view, partly in section, of the tool box when the light means is off by moving the switch member.

Referring to FIGS. 5 and 6, the collapsible member 6 can be pulled to magnetically adhere a bit 34 which drops on the ground without bowing downwardly. The switch member 8 is moved to press the second end of the first conducting plate 92 to contact the first end of the second conducting plate 91 to light up the bulb 42. Referring to FIGS. 7 and 8, when shifting the switch member 8 reversely, the second end of the first conducting plate 92 is not pressed so that it returns to its original position where the first and the second conducting plate 92/91 are separated apart and the bulb 42 is off.

Therefore, the tool box of the present invention has a compact size and owns a plurality of functions.

While particular embodiments of the present invention have been illustrated and described herein, it is not intended to limit the invention and changes and modifications may be made therein within the scope of the invention as hereinafter claimed.

What is claimed is:

1. A tool box comprising:

a base and a cover which is pivotally mounted to said base which has a first side, a second side, a first end and a second end, a first separating plate and a second separating plate respectively and longitudinally disposed to said base such that a first space is defined between said first side of said base and said first separating plate, and a second space is defined between said first and said second separating plate, said first separating plate having a slit defined therein, a tubular member formed to said first end of said base and having a polygonal passage defined therein, a first curved recess defined in said first end of said base and communicating with said second space;

a receiving member pivotally connected between said first end and said second end of said base, a spring disposed between said base and an underside of said receiving member, said receiving member having a plurality of notches defined in a first side thereof;

a light means received in said second space and comprising at least one battery, a bulb frame with a bulb disposed thereto, said bulb frame contacting a positive electrode of said battery, a first conducting plate received in said first space and having a first end thereof extending through said slit of said first separating plate and contacting said bulb frame, a second conducting plate received in said first space and having a first end and a second end which contacts a negative electrode of said battery, and a switch member slidably disposed to said first side of said base and having a protrusion formed thereto which slidably presses said first end of said second conducting plate to separate from a second end of said first conducting plate.

2. The tool box as claimed in claim 1 wherein said bulb frame is made of conductive material.

3. The tool box as claimed in claim 1 further comprising a third separating plate disposed to said base and a third space defined between said third separating plate and said second side of said base, a collapsible member fixedly received in said third space and having a magnetic member disposed to a distal end thereof which extends from said first end of said base.

4. The tool box as claimed in claim 3 further comprising an extension rod received between said tubular member and said third separating plate.

5. The tool box as claimed in claim 4 wherein said extension rod has a first end being a polygonal end and a second end with a polygonal recess defined therein.

6. The tool box as claimed in claim 3 wherein said receiving member has a stub extending from each one of two ends thereof, a mediate plate extending perpendicularly from said third separating plate, each of said second end and said mediate plate having a dent defined therein so as to respectively received said stub corresponding thereto.

7. The tool box as claimed in claim 6 wherein each stub is located below a central axis of said corresponding end of said receiving member.

8. The tool box as claimed in claim 1 wherein each stub is located near a second side of said receiving member.

9. The tool box as claimed in claim 1 wherein said base has a clamping member fixedly connected to an outer side thereof.

* * * * *